US005346131A

United States Patent [19]

Meier et al.

[11] Patent Number: 5,346,131

[45] Date of Patent: Sep. 13, 1994

[54] DEVICE FOR SUPPORTING RAILS

[75] Inventors: Peter Meier, Sevelen; Ralf Ludwig, Sennwald, both of Switzerland; Klaus Wechselberger, Feldkirch, Austria

[73] Assignee: Hilti Aktiengesellschaft, Furstentum Liechtenstein, Fed. Rep. of Germany

[21] Appl. No.: 10,231

[22] Filed: Jan. 28, 1993

[30] Foreign Application Priority Data

Feb. 28, 1992 [DE] Fed. Rep. of Germany ..... 4206207
Jun. 25, 1992 [DE] Fed. Rep. of Germany ..... 4220799

[51] Int. Cl.[5] ..... E01B 9/38; E01B 9/68
[52] U.S. Cl. ..... 238/283; 238/382
[58] Field of Search ..... 238/264, 283, 301, 302, 238/304, 306, 307, 382

[56] References Cited

U.S. PATENT DOCUMENTS 4,266,719 5/1981 Ortwein et al. ..... 238/283
4,577,801 3/1986 Ortwein ..... 238/283
4,632,308 12/1986 Fischer ..... 238/283 X

FOREIGN PATENT DOCUMENTS 2817278 10/1979 Fed. Rep. of Germany ..... 238/382
3030936 4/1982 Fed. Rep. of Germany .
3406679 9/1985 Fed. Rep. of Germany ..... 238/283

*Primary Examiner*—Michael S. Huppert
*Assistant Examiner*—James Eller
*Attorney, Agent, or Firm*—Anderson Kill Olick & Oshinsky

[57] ABSTRACT

Device for supporting rails in a railroad track for rail-borne vehicles includes a support plate (3) positioned on a support bed (6) with profiled surfaces on the support plate and the support bed having upwardly extending flanks (4*a*, 7*a*, 5*a*, 8*a*) forming different angles. The flanks extend in the long direction of the railroad track. Elastic elements (9*a*, 9*b*, 9*c*, 9*d*) are disposed between the flanks (4*a*, 7*a*, 5*a*, 8*a*) of the support plate in the support bed, whereby the support plate can pivot relative to the support bed when a load ($P_H$, $P_V$) acts on the rails. The support plate pivots toward the center of the railroad track. As a result, the rail head (1*d*) of the rail attached to the support plate (3) is essentially offset vertically during the pivoting action, so that the rail gauge of the railroad track remains unchanged.

11 Claims, 2 Drawing Sheets

(not loaded)
EXTERNAL SIDE OF THE RAILROAD TRACK
CENTER OF THE RAILROAD TRACK
1
1a
1b
1c
1d
3
3a
3b
4
4a
4b
5
5a
5b
6
6c
6d
7
7a
7b
8
8a
8b
9a
9b
9c
9d
10
U

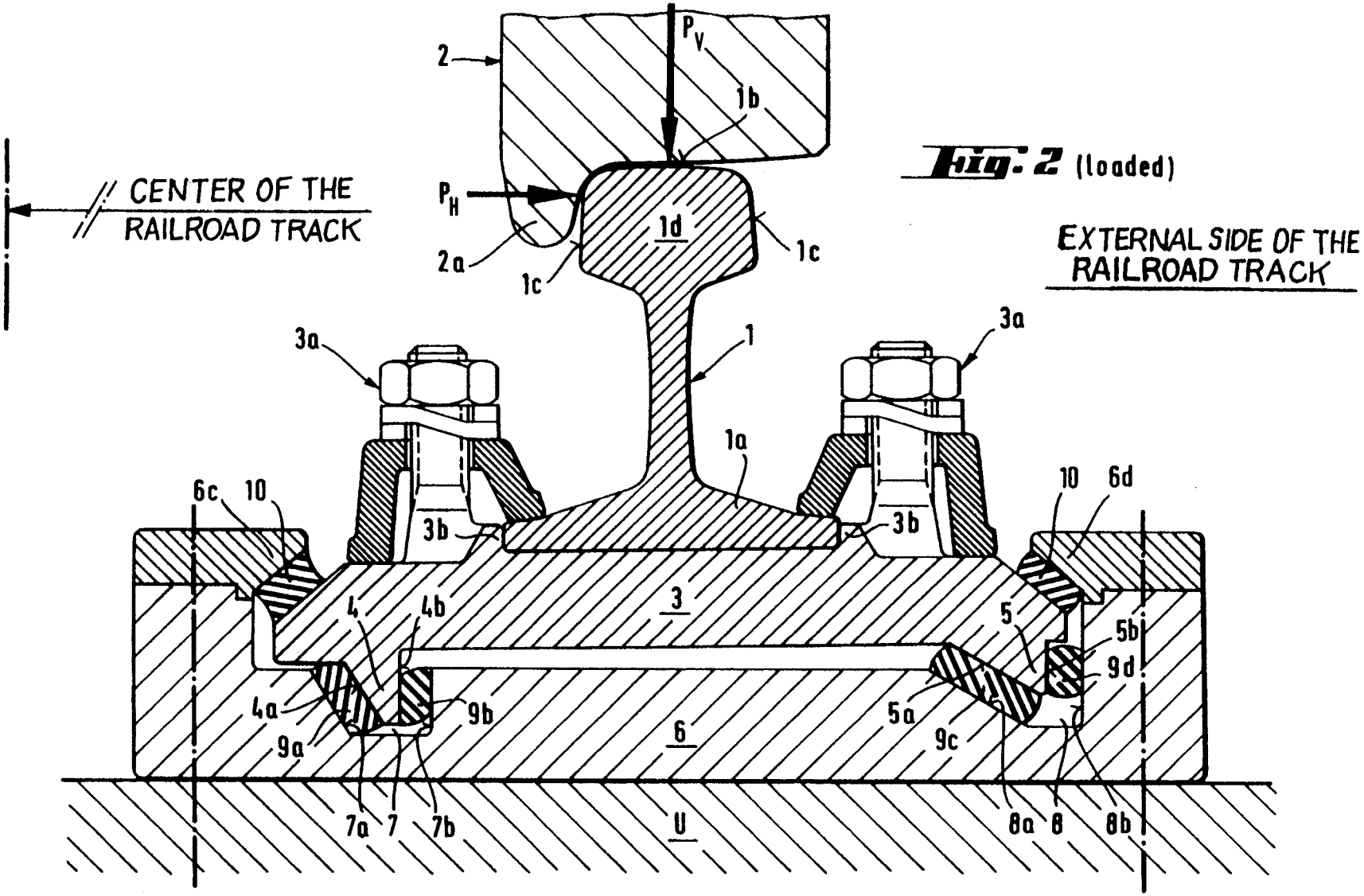
Fig. 2 (loaded)

DEVICE FOR SUPPORTING RAILS

BACKGROUND OF THE INVENTION

The present invention is directed to a device for supporting rails of a railroad track used for conveying rail cars and the device includes a support plate positioned on a support bed with the support plate and support bed having interengaging profiled surfaces extending in the long direction of the track with the interposition of elastic elements at least in certain regions. The profiled surfaces include flanks extending in the long direction and at least two of the flanks extend at an angle different from 90° with respect to a line perpendicular to a plane of the track with the angle diverging in the direction upwardly toward the top of the rail.

When rail cars travel over railroad track, due to the weight of the rail cars and the speed at which they travel over the track, shock loads of different magnitudes, noises and lateral forces develop especially on curves. To dampen the shock loads, reduce the noise, and counter the lateral forces, support devices are known made up of support plates and a support bed, where one rail is fastened to the support plate and elastic elements are disposed between the support plate and the support bed. Particularly in curved sections of a railroad track, high lateral forces occur, in addition to the loads resulting from the weight of the railroad cars which are generated by guidance forces of the cars. These higher forces in curved sections of the railroad track result in high stresses in the support plates and support bed.

The vertical movement of a support plate can be controlled when a load is developed by an arrangement of elastic elements located between the support plate and the support bed. By providing these elastic elements with specific geometrical shapes, their elastic behavior can be influenced.

In DE-OS 30 30 936 an arrangement for supporting rails is shown where the rail is fastened to a support plate which abuts by means of a profiled surface and the interposition of elastic elements against a support bed.

The cross-sectional shape of the profiled surface is essentially trapeze-shaped. Accordingly, the elastic elements are arranged inclined obliquely to one another and form an angle which is open towards the top of the rail. The elastic elements closer to the center of the railroad track form a smaller angle with a line perpendicular to the plane of the railroad track installation than the elastic elements disposed on the outer side of the railroad track.

This known arrangement has the disadvantage that the support plate, depending upon the direction of the load, can assume a position, with respect to the support bed, tilted towards the middle or the outer side of the railroad track. Such inclination of the support plate towards the outside of the railroad track causes an essentially horizontal offset of the rail head toward the outside. As a result, an undesirable gauge widening occurs, which apart from the increased wear, in case of a possibly occurring rail fracture in a curved section of the railroad track, can lead to a derailment of the rail cars. The carrying of guidance forces is no longer possible.

An additional disadvantage of this known arrangement involves the support plate tilting in a very pronounced manner towards the center of the railroad track on the occurrence of high forces acting in the vertical direction, with the result that the rail head performs a large horizontal movement towards the center of the track. Such a situation causes a distinct narrowing of the rail gauge. Narrowing of the rail gauge in railroad tracks causes high wear in the region of the wheel flange and in the region of the side flanks of the rail head as well as a high rolling resistance and noise generation.

SUMMARY OF THE INVENTION

The primary object of the present invention is to provide a device or arrangement for the support of the rail which guarantees maintenance of the rail gauge independently of stresses developed in curved sections.

In accordance with the present invention, profiled surfaces on the support plate and the support bed form angles which diverge from a perpendicular line to the plane of the track with the angle opening upwardly toward the center of the track and, with regard to the angular measurement, the angles increase from the inside of the rail relative to the center of the track to the outside of the rail.

Due to the angular disposition of flanks formed by the profiled surfaces and the elastic elements between the flanks of the support plate and the support bed, the possibility is created that the rail along with the support plate can pivot about an axis where the axis is located in each rail on the outside of the railroad track possibly at the level of the rail head.

As a result, the stresses resulting from the weight of the rail cars and the lateral forces developed in curved sections cause a pivoting of the support plate and the rail attached to it, whereby the support plate leans toward the center of the rail track. During such pivoting action, the support plate moves not only essentially perpendicularly to the profiled surface of the support bed, but rather also horizontally towards the outside of the railroad track. This compensates for the horizontal offset of the rail head originating in the course of the pivoting action of the rail. Accordingly, the head of the rail remains in its stable horizontal position. Disadvantageous rail gauge widening of the railroad track, which also has dangerous consequences, is prevented.

The pivoting motion of the support plate relative to the support bed can be assisted by support elements, such as plain bearings, rollers, or balls, arranged respectively between the flanks of the profiled surfaces of the support plate and the support bed. In the device of the present invention, the elastic elements disposed between the support plate and the support bed are compressed to a different extent by the developed stresses.

Tests have shown that the pivoting action between the support plate and the support bed proceeds in a particularly satisfactory manner if the angle of the flanks formed relative to a perpendicular is in the range of 5° to 85°.

The profiled surfaces preferably include additional flanks running essentially perpendicularly to the plane of the railroad track. Basically, the flanks have the task of carrying transverse or lateral forces developed by the guidance forces of the rail cars when traveling through curved sections.

At least in a portion of the flanks, elastic elements are disposed between the support plate and the support bed. The elastic elements have the property of being able to carry transverse forces in a more elastic manner than compressive or pressure forces. By arranging the flanks at different angles, the different movement behavior of the flanks relative to the elastic elements can be controlled when loads are applied. Depending on the arrangement of the flanks, transverse or lateral forces of different magnitudes can then be applied to the elastic elements. To enable the desired pivoting action between support plates and support bed, the corresponding movement behavior of the flanks relative to the elastic element can be employed.

The elastic elements can be solely arranged in such a way in the region of the profiled surfaces that they assure the support plates being pressed back into the normal position.

Preferably the elastic elements are formed of synthetic rubber, natural rubber, cork, polyurethane or polysulfide. These materials have the characteristic of acting in flexural or elastic manner when subjected to transverse forces and to remain in their stable shape when acted upon by compressive forces.

The preferred forms of the elastic elements are of rectangular, square, trapezium-shaped, round or polygonal cross-section. Depending on the shape of the profiled surfaces on the support plate and the support bed, the elastic elements can have the above-mentioned cross-sections. As pointed out above, specific elastic flexural behavior of the elastic elements can be achieved by appropriate shaping of such elements.

The profiled surfaces are advantageously formed by at least two tooth-shaped projections on the support plates and corresponding recesses in the support bed. The profiled surfaces shaped as tooth-shaped projections extend parallel to the long axis of the track. A device for supporting rails with profiled surfaces comprising two tooth-shaped projections is positionally very stable when subjected to the forces which may arise, since the tooth-shaped projections are spaced essentially far apart in the region of the outer side of the support plate or support bed. The rail attached to the opposite side of the support plate from the profiled surfaces is thus located between two tooth-shaped projections. In place of two tooth-shaped projections, it is also possible to provide several tooth-shaped projections extending parallel to one another across the width of the support plate and support bed disposed at right angles to the long axis of the rail.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

BRIEF DESCRIPTION OF THE DRAWING

In the drawing:

FIG. 2 is a cross-sectional view similar to FIG. 1, however, with a load applied to the rail.

DETAILED DESCRIPTION OF THE INVENTION

Figure 1:
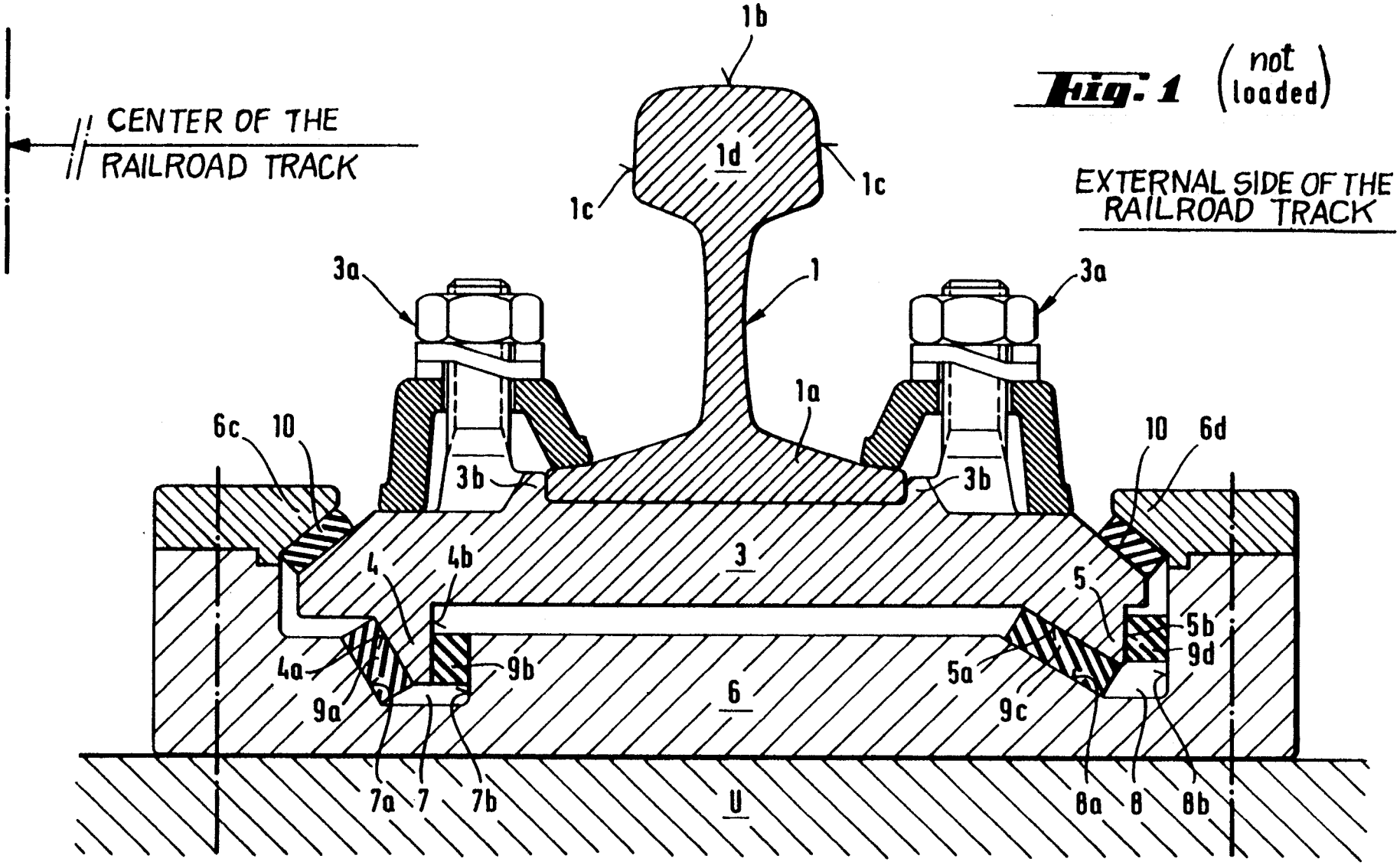
FIG. 1 is a transverse cross-sectional view of a rail support device embodying the present invention and illustrated in the unloaded state.

In FIGS. 1 and 2, one rail 1 of a railroad track is shown with the rail comprising a bottom flange or base 1*a*, a rail head 1*d*, with a top face or surface 1*b* and with side flanks 1*c* extending downwardly from the top surface. Rail 1 is secured to a support plate 3 by fasteners 3*a* . The horizontal side displacement or side guidance of the rail 1 is afforded by projections 3*b* extending upwardly from the upper surface of the support plate 3.

Support plate 3 is positioned on a support bed 6 and the two have interengaging profiled surfaces which, in the illustrated example, comprise two tooth-shaped projections 4, 5 projecting downwardly from the lower surface of the support plate 3 and two correspondingly arranged recesses 7, 8 located in the upper surface of the support bed 6. The tooth-shaped projections 4, 5 project with the interposition of elastic elements 9*a*, 9*b*, 9*c*, 9*d* into the recesses 7, 8 in the support bed 6 fastened on a solid subsurface U, for instance, a railroad tie by means of fasteners, not shown.

If no load is applied to the railroad track as shown in FIG. 1, the elastic elements 9*a*,9*b*, 9*c*, 9*d* maintain the support plate and the support bed at the original spacing from one another. The tooth-shaped projections 4, 5 and the recesses 7, 8 have flanks 4*a*, 7*a*, 5*a*, 8*a* extending at an angle other than 90° , that is, obliquely, to a line perpendicular to the plane of the railroad track, that is, a plane extending across the top surface ld of the two rails forming the track. The flanks 4*a*, 7*a*, 5*a*, 8*a* are inclined in such a way that they form different angles with the perpendicular so that the flanks diverge upwardly relative to the perpendicular toward the center of the railroad track. As far as their angular measure is concerned, the angles thus formed increase from the inside of the rail 1 relative to the center of the railroad track to the outside of the rail 1. Accordingly, the flanks 4*a*, 7*a* closer to the center of the railroad track extend more steeply relative to a horizontal line than the flanks 5*a*, 8*a* which are located further from the center of the railroad track.

The tooth-shaped projection 4 closer to the center of the railroad track is shaped to be more pointed than the other tooth-shaped projection 5. The elastic elements 9*a*, 9*b*, 9*c*, 9*d* have the property to respond in a more flexural or elastic manner to transverse forces than to compressive forces.

To secure the support plate 3 and thus hold the rail 1 vertically, the support bed 6 embraces the support plate 3 at least partially with embracing parts 6*c*, 6*d*. To prevent the support plate 3 from jumping off the support bed 6 and to prevent corrosion as well as contamination in the region of the profiled surfaces, elastic stabilizers 10 are positioned between opposing surfaces of the parts 6*c*, 6*d* and of the support plate 3 with the parts 6*c*, 6*d* pressing the elastic stabilizers 10 against the support plate 3. The parts 6*c* and 6*d* are connected to the support bed 6.

So that the device for supporting rails 1 provides adequate resistance against slipping of the rails, the support plate is shaped so that it projects beyond the support bed in the long direction of the rail with a protruding portion of the support plate extending vertically downwardly and partially overlapping the support bed 6. This arrangement of the support plates is not illustrated. Additional elastic elements are disposed between support plate 3 and support bed 6 and provide appropriate resistance against rail slippage.

FIG. 2 shows the device when a wheel 2 of a rail car, not shown, rests on the top surface 1*b* of the rail 1 with the wheel flange 2*a* contacting the inside rail flank 1*c* of the rail head 1*d*. The horizontal loads $P_H$ and the vertical loads $P_V$ as well as the shared pro rata weight made up of the weight of the rail car itself and the weight of the car's contents, are transmitted by the wheel 2 to the rail head 1*d* of the rail 1.

In the region of the more pointed tooth-shaped projection 4 higher transverse forces are applied to the elastic elements 9*a*, 9*b* than to the elastic elements 9*c*, 9*d* in the region of the toothed-shaped projection 5. Due to the different transverse forces acting on the elastic elements 9*a*, 9*b*, 9*c*, 9*d* in the region of the pointed tooth-shaped projection 4 a larger movement of the support plate 3 occurs relative to the elastic elements 9*a*, 9*b* when under load than in the region of the toothed-shaped projection 5. As a result, the support plate 3 leans toward the center of the railroad track and the elastic elements 9*a*, 9*b*, 9*c*, 9*d* deform because of the occurring transverse forces and compressive forces.

Contrary to the deforming stabilizers 10 located in the region of the outside of the railroad track, the stabilizers 10 located closer to the center of the railroad track are unloaded when a load or stress occurs. The essentially horizontally acting stresses $P_H$, which arise due to the guidance forces of the rail cars when traveling along curved sections, are carried by the elastic segments 9*b*, 9*d* disposed parallel to the vertical. The elastic elements 9*c*, 9*d* abut the flanks 4*b*, 7*b*, and 5*b*, 8*b*, respectively.

Due to the more pronounced one-sided dipping of the tooth-shaped projection 4 into the recess 7, there also occurs a leaning of the rail 1 attached to the support plate 3, whose rail head is basically offset only vertically.

While specific embodiments of the invention have been shown and described in detail to illustrate the inventive principles, it will be understood that the invention may be embodied otherwise without departing from such principles.

We claim:

1. Device for supporting a rail (1) extending in a long direction and located in a railroad track for railborne vehicles, each said rail having a top surface located in a generally horizontal plane of said railroad track, said railroad track comprising a pair of spaced rails having a center therebetween extending in the long direction, said device comprising a support plate (3) positioned on a support bed (6), interengaging profiled surfaces on said support plate (3) and support bed (6) and extending in the long direction of said rails, elastic elements interposed at least in certain regions between said profiled surfaces, said profiled surfaces comprising sets of flanks (4*a*, 7*a*, 4*b*, 7*b*, 5*a*, 8*a*, 5*b*, 8*b*) disposed in spaced facing relation and extending in the long direction of said rails, said sets of flanks including at least two sets of first flanks extending at an angle different from 90° with respect to a line perpendicular to the plane containing the top surfaces of said rails, the angle of said at least two sets of first flanks diverging from the perpendicular line in the upward direction towards the center of the railroad track and the angles increasing in angular measurement relative to the center of the said railroad track from inside said rails to outside said rails.

2. Device, as set forth in claim 1, wherein said angle different from 90° is in the range of 5° to 85° .

3. Device, as set forth in claim 1 or 2, wherein said flanks of said profiled surfaces include sets of second flanks (4*b*, 7*b*, 5*b*, 8*b*) disposed in spaced facing relation and extending substantially perpendicularly to the plane containing the top surfaces of the rails.

4. Device, as set forth in claim 3, wherein said elastic elements (9*a*, 9*c*) are located between a portion of said at least two sets of first flanks and extend between said support plate (3) and the support bed (6).

5. Device, as set forth in claim 4, wherein said elastic elements (9*a*, 9*b*, 9*c*, 9*d*) are formed of one of the materials selected from the group consisting of synthetic rubber, natural rubber, cork, polyurethane and polysulfide.

6. Device, as set forth in claim 5, wherein said elastic elements (9*a*, 9*b*, 9*c*, 9*d*) have a rectangular cross-section.

7. Device, as set forth in claim 5, wherein said elastic elements (9*a*, 9*b*, 9*c*, 9*d*) have a square cross-section.

8. Device, as set forth in claim 5, wherein said elastic elements (9*a*, 9*b*, 9*c*, 9*d*) have a trapezium-shaped cross-section.

9. Device, as set forth in claim 5, wherein said elastic elements (9*a*, 9*b*, 9*c*, 9*d*) have a round cross-section.

10. Device, as set forth in claim 5, wherein said elastic elements (9*a*, 9*b*, 9*c*, 9*d*) have a polygonal cross-section.

11. Device, as set forth in claim 1, wherein said profiled surfaces comprise at least two tooth-shaped projections (4,5) spaced laterally apart on said support plate (3) and correspondingly shaped recesses (7, 8) spaced laterally apart on said support bed (6) and aligned opposite said tooth-shaped projections (4, 5).

* * * * *

UNITED STATES PATENT AND TRADEMARK OFFICE

CERTIFICATE OF CORRECTION

PATENT NO. : 5,346,131

DATED : September 13, 1994

INVENTOR(S) : Peter Meier, et al.

It is certified that error appears in the above-indentified patent and that said Letters Patent is hereby corrected as shown below:

On the title page, item [54], and column 1, the title should read--

DEVICE FOR SUPPORTING RAILROAD RAILS.

--

Signed and Sealed this

First Day of November, 1994

*Attest:*

*Attesting Officer*

BRUCE LEHMAN

*Commissioner of Patents and Trademarks*